US006322960B1

(12) United States Patent
Murakami et al.

(10) Patent No.: US 6,322,960 B1
(45) Date of Patent: Nov. 27, 2001

(54) SILVER HALIDE EMULSION

(75) Inventors: Shuji Murakami, Odawara; Koichiro Kuroda, Hino; Yumiko Osawa, Hino; Junji Ito, Hino; Shinichi Suzuki, Hino, all of (JP)

(73) Assignee: Konica Corporation (JP)

( * ) Notice: Subject to any disclaimer, the term of this patent is extended or adjusted under 35 U.S.C. 154(b) by 0 days.

(21) Appl. No.: 09/513,480

(22) Filed: Feb. 25, 2000

(30) Foreign Application Priority Data

Mar. 1, 1999 (JP) ..... 11-052558

(51) Int. Cl.[7] ..... G03C 1/09; G03C 1/035

(52) U.S. Cl. ..... 430/567; 430/569; 430/599; 430/604; 430/605

(58) Field of Search ..... 430/567, 569, 430/599, 604, 605

(56) References Cited

U.S. PATENT DOCUMENTS 5,360,712 * 11/1994 Olm et al. ..... 430/567
5,480,771 1/1996 Bell .
5,500,335 * 3/1996 Bell ..... 430/567
5,503,970 * 4/1996 Olm et al. ..... 430/567
5,503,971 * 4/1996 Daubendiek et al. ..... 430/567
5,547,827 * 8/1996 Chen et al. ..... 430/567
5,783,378 7/1998 Mydlarz et al. .
5,792,601 * 8/1998 Edwards et al. ..... 430/567

FOREIGN PATENT DOCUMENTS 0743553 11/1996 (EP) .

OTHER PUBLICATIONS

European Search Report EP 00 30 1620.

* cited by examiner

*Primary Examiner*—Janet Baxter
*Assistant Examiner*—Amanda C Walke
(74) *Attorney, Agent, or Firm*—Jordan B. Bierman; Bierman, Muserlian and Lucas

(57) ABSTRACT

A silver halide emulsion is disclosed, containing silver halide grains having a chloride content of not less than 90 mol %, wherein the silver halide grains each are internally doped with compound (A), compound (B) and compound (C); compounds (A) and (B) each meeting specified requirements and compound (C) being an iridium compound.

14 Claims, No Drawings

SILVER HALIDE EMULSION

FIELD OF THE INVENTION

The present invention relates to silver halide photographic emulsions and silver halide photographic light sensitive materials and in particular to silver halide photographic emulsions exhibiting stable performance independent of humidity at the time of exposure and having superiority in latent image stability, sensitivity and contrast and silver halide color photographic light sensitive materials by the use thereof.

BACKGROUND OF THE INVENTION

Along with recent popularization of compact labs, exposure of printing of silver halide photographic print paper is conducted at various kinds of places, and accordingly exposure is done under various conditions.

The use of exposure printers is accompanied by emission, which affects the temperature or humidity of ambient surroundings. Particularly, the use of color print paper, of which photographic performance is easily varied with temperature or humidity of the surroundings, causes unfavorable variation in color tone. Specifically at the time of starting of printing, print paper is easily affected under changes in temperature or humidity over time, producing problems such that in cases when a large number of prints of the same picture are made, a marked difference in tone between the start and the finish of printing occurs.

Iridium compounds are effective for improvement in reciprocity law failure, as disclosed in JP-B 43-4935 (hereinafter, the term, JP-B means a published Japanese Patent) and U.S. Pat. No. 4,997,751 and are also effective in increasing contrast. However, the use of the iridium compound results in deterioration in latent image stability at the initial stage after exposure, as described in Journal of Photographic Science vol. 33, page 201.

JP-A 10-307357 (hereinafter, the term, JP-A means an unexamined and published Japanese Patent Application) discloses a technique of introducing a deep and permanent electron trap into the interior of silver halide grains and satisfying a specified equation, thereby leading to enhanced high contrast of roomlight-handling photographic materials. JP-A 10-186558 discloses a technique of improving exposure dependence on humidity by the use of an emulsion evaluated on the basis of microwave photoconduction. However, sufficient photographic performance has not been obtained by these techniques.

SUMMARY OF THE INVENTION

An object of the present invention is to provide a silver halide emulsion having high sensitivity and sufficient contrast suitable for silver halide color print paper and exhibiting latent image stability little affected by humidity at the time of exposure and a silver halide color photographic material.

The object of the present invention can be accomplished by the following constitution:

1. A silver halide emulsion containing silver halide grains having a chloride content of not less than 90 mol %, the silver halide grains each being internally doped with the following compound (A), compound (B) and compound (C): compound (A) meeting at least one of the following (a1) to (a6), except for compound (C);

(a1) a compound exhibiting an effect of enhancing an intensity of a microwave photoconduction signal, (a2) a compound exhibiting an effect of increasing a decay time of a microwave photoconduction signal intensity, (a3) a compound exhibiting an effect of enhancing a photographic sensitivity, (a4) a compound forming a shallow electron trap capable of releasing a trapped electron in a time of less than 50 ns, (a5) a compound forming an electron trap shallower than that of compound (C), or (a6) a compound forming an electron trap of a depth of 0.03 to 0.3 eV;

compound (B) meeting at least one of the following (b1) to (b6), except for compound (C);

(b1) a compound exhibiting an effect of lowering an intensity of a microwave photoconduction signal, (b2) a compound exhibiting an effect of decreasing a decay time of a microwave photoconduction signal intensity, (b3) a compound exhibiting an effect of reducing a photographic sensitivity, (b4) a compound forming a deep electron trap capable of holding a trapped electron in a time of not less than 5 sec., (b5) a compound forming an electron trap deeper than that of compound (C), or (b6) a compound forming an electron trap of a depth of not less than 0.6 eV;

compound (C) of an iridium compound;

2. The silver halide emulsion described in 1., wherein the silver halide grains each are internally doped with compound (A) and exhibiting an intensity of a microwave photoconduction signal, a decay time of a microwave photoconduction signal intensity or a sensitivity of at least two times that of silver halide grains which are not doped with compound (A);

3. The silver halide emulsion described in 1., wherein the silver halide grains each are internally doped with compound (B) and exhibiting an intensity of a microwave photoconduction signal, a decay time of a microwave photoconduction signal intensity or a sensitivity of not more than ½ times that of silver halide grains which are not doped with compound (B);

4. The silver halide emulsion described in 1., wherein the silver halide grains each contain a region doped with compound (C) and a region doped with compound (B), the region doped with compound (C) and said region doped with compound (B) being adjacent or overlapping each other in the grain;

5. The silver halide emulsion described in 1., wherein the silver halide grains each contain a region doped with compound (C) and a region doped with compound (A), the region doped with compound (C) and the region doped with compound (A) being adjacent or overlapping each other in the grain;

6. The silver halide emulsion described in1., wherein the silver halide grains each contain a region doped with compound (A) and a region doped with compound (B), the region doped with compound (A) and the region doped with compound (B) being adjacent or crossed with each other in the grain;

7. The silver halide emulsion described in 1., wherein said silver halide grains each contain a region doped with compound (A) in the grain and the boundary of the region doped with compound (A) that is nearest to the surface of the grain is located at a depth of 0.01 to 0.035 $\mu$m from the grain surface;

8. The silver halide emulsion described in 1., wherein the silver halide grains each contain a region doped with compound (A) in the grain and the boundary of the region doped with compound (A) that is nearest to the surface of the grain is in the grain between 60 to 90% of the grain volume;

9. The silver halide emulsion described in 1., wherein the silver halide grains each contain a region doped with compound (C) in the grain and the boundary of the region doped with compound (C) that is nearest to the surface of the grain is located at a depth of 0.01 to 0.035 μm from the grain surface;

10. The silver halide emulsion described in 1., wherein the silver halide grains each contain a region doped with compound (C) in the grain and the boundary of the region doped with compound (C) that is nearest to the surface of the grain is in the grain between 60 to 90% of the grain volume;

11. The silver halide emulsion described in 1., wherein the silver halide grains each contain a region doped with compound (B) and a region doped with compound (C) in the grain, said region doped with compound (B) being internal to the region doped with compound (C);

12. The silver halide emulsion described in 11., wherein the silver halide grains further contain a region doped with compound (A) in the grain, said region doped with compound (A) being external to the region doped with compound (B);

13. The silver halide emulsion described in 12., wherein the region doped with compound (A), region doped with compound (B) and region doped with compound (C) each have a width of not more than 20 mol %, based on silver of the grain.

14. A high chloride silver halide emulsion containing silver halide grains having a chloride content of not less than 90 mol %, the silver halide grains each being doped in the grain with at least three metal complexes different in metal valence number and at least one of the complexes of metals being an iridium containing compound;

15. The silver halide emulsion described in 14. above, wherein a region doped with a metal complex having a higher metal valence number is more interior than a region doped with a metal complex having the lowest metal valence number;

16. The silver halide emulsion described in 15, wherein the complex of a metal having a higher valence number is a compound different from the iridium containing compound;

17. A high chloride silver halide emulsion containing silver halide grains having a chloride content of not less than 90 mol %; the silver halide grains each being doped in the grain with an iridium compound, a rhodium compound, an osmium compound and an iron compound; a rhodium compound-doped region and an osmium compound-doped region are internal to an iridium compound-containing region in the grain;

18. A high chloride silver halide emulsion containing silver halide grains having a chloride content of not less than 90 mol %; the silver halide grains being doped with an iridium compound and at least a metal complex having a metal valence number of three or more; a region doped with the metal complex having a metal valence number of three or more being internal to a region containing the iridium compound;

19. A high chloride silver halide emulsion containing silver halide grains having a chloride content of not less than 90 mol %, wherein the silver halide grains being doped in the grain with three compounds capable of forming electron traps different in depth from each other;

20. The silver halide emulsion described in 19. above, wherein a region containing a compound forming the deepest electron trap is internal to the regions doped with other two compounds;

21. A silver halide color photographic light sensitive material containing the silver halide emulsion described in any of 1. through 20. above.

DETAILED DESCRIPTION OF THE INVENTION

Compounds (A), (B) and (C) can be judged in the following manner. Compounds (A) and (B) are evaluated by measurement of microwave photoconduction in such a manner that using a silver halide emulsion containing silver halide grains homogeneously doped with a compound to be judged in an amount of $10^{-8}$ to $10^{-4}$ mol/mol Ag, a measurement sample is prepared in accordance with JP-A 10-186558 and measurements are conducted with respect to the intensity of a microwave photoconduction signal (hereinafter, also referred to as a signal intensity) and the decay time of the microwave photoconduction signal intensity (hereinafter, also referred to as a decay time of the signal intensity).

Measurement of microwave photoconduction described in JP-A 10-186558 will be described. A silver halide emulsion X comprised of silver bromochloride grains containing 99.5 mol % chloride was prepared as follows.

Preparation of silver halide emulsion

To 1 liter of an aqueous 2% gelatin solution maintained at 40° C. are simultaneously added solutions A and B in 20 min., while the pAg and pH were controlled at 7.3 and 3.0, respectively; thereafter, solutions C and D are simultaneously added in 120 min., while the pAg and pH were controlled at 8.0 and 5.5, respectively. The pAg is controlled by the method described in JP-A 59-45437 and the pH was adjusted with sulfuric acid or aqueous sodium hydroxide. After completing the addition, the resulting emulsion is desalted using aqueous 5% Demol (available from Kao-Atlas) and aqueous 20% magnesium sulfate and then redispersed in an aqueous gelatin solution to obtain monodisperse cubic grain emulsion X comprised of silver bromochloride grains having an average grain size of 0.40 μm and a variation coefficient of grain size distribution of 0.08 and containing 99.5 mol % chloride.

| | |
|---|---|
| Solution A | |
| Sodium chloride | 0.48 g |
| Potassium bromide | 0.004 g |
| Water to make | 1 lit. |
| Solution B | |
| Silver nitrate | 1.4 g |
| Water to make | 1 lit. |
| Solution C | |
| Sodium chloride | 129.4 g |
| Potassium bromide | 0.133 g |
| Water to make | 661 ml |
| Solution D | |
| Silver nitrate | 376.6 g |
| Water to make | 661 ml |

As described in JP-A 10-186558 (at page 3), the thus prepared emulsion is mixed to prepare a coating solution having a ratio of gelatin to silver of 0.6. After adding thereto a surfactant (SU-2) to adjust surface tension, the coating solution is coated on a 120 μm thick triacetyl cellulose film to obtain a coating sample having a silver coverage of 1.2

$g/m^2$. Using the thus obtained coating sample, microwave photoconduction is measured to determine its photoconductivity signal intensity and decay time of the intensity in the excitation absorption, in accordance with the method described in JP-A 5–45758 at pages 2–3, in which excitation is achieved with ultraviolet rays using a light source filtered with UVD-33S filter (available from TOSHIBA Glass Co. Ltd.). The decay time is defined as the time taken for decay to reach half the value of the maximum intensity.

Next, emulsion Y is prepared in a manner similar to emulsion X, except that a compound to be evaluated is added to solutions A and B so that $10^{-8}$ mol/mol Ag of the compound to be evaluated is homogeneously doped in the grain. Using the thus prepared emulsion Y, the signal intensity and decay time are similarly determined. In cases where the signal intensity or the decay time of emulsion Y is less than that of emulsion X, the compound is judged to be compound (B). In other cases, it is necessary to prepare emulsion Z to evaluate the compound. Emulsion Z is prepared similarly to emulsion Y, except that the amount of the compound is increased to $10^{-5}$ mol/mol Ag. Using emulsion Z, the signal intensity and the decay time are similarly measured. In cases where the signal intensity or the decay time of emulsion Z is more than that of emulsion X, the compound is evaluated to be compound (A). In the case of it being less, the compound is evaluated to be compound (B) and in the case of it being equivalent, the compound is evaluated to be neither compound (A) nor compound (B).

Silver halide grains contained in the emulsion contain not more than 90 mol % chloride. In cases where a halide other than chloride is contained, the silver halide grains are to be prepared so that the halide is uniformly distributed in the grain. The silver halide grains thus prepared contain no compound other than chloride, bromide, iodide and the compound to be evaluated.

In the case when a silver halide emulsion containing the compound to be evaluated exhibits a higher signal intensity or a longer decay time of the signal intensity than a silver halide emulsion), which is prepared in the same manner as emulsion containing the compound, except that the compound is excluded, the compound is evaluated to be compound (A); In the case when the emulsion containing the compound exhibits a lower signal intensity or a shorter decay time of the signal intensity than the emulsion not containing the compound, the compound is evaluated to be compound (B).

The evaluation can also be made by subjecting the silver halide emulsion containing the compound to be judged to an optimum gold sulfur chemical sensitization commonly known in the art. Further, the emulsion to be judged may be chemically sensitized with a chalcogen sensitizer and a noble metal sensitizer other than a sulfur and gold sensitizer. The evaluation is made using an emulsion which has been optimally subjected to chemical sensitization. In the case when the chemically sensitized emulsion containing a compound to be evaluated exhibits enhanced sensitivity, as compared to a chemically sensitized emulsion not containing the compound, the compound is evaluated to be compound (A); and in the case of reduced sensitivity, the compound is evaluated to be compound (B).

Compound (A) may be any compound, an occlusion of which is capable of enhancing sensitivity, including metal complexes, reduction sensitizers and sensitizing dyes. Those which are more effective in enhancing sensitivity are preferably employed. Complexes in which iron, ruthenium or osmium is coordinated with four or more cyano are specifically preferred. Exemplary examples of compound (A) are shown below, but the compound is not limited to these examples.

(A1) $K_4Fe(CN)_6$
(A2) $CdCl_2$
(A3) $K_4Ru(CN)_6$
(A4) $K_4Os(CN)_6$
(A5) Ascorbic acid
(A6) Sorbic acid
(A7) Thiourea
(A8) $SnCl_2$
(A9) $NH_4SCN$ Similarly, compound (B) may be any compound, an occlusion of which is capable of reducing sensitivity, including metal complexes, desensitizing dyes and electron-trapping agents. Those which are more effective in reducing sensitivity are preferably employed. Complexes in which iron, ruthenium or osmium is coordinated with four or more halogen are specifically preferred. A complex of a metal having a higher valence number is more preferred.

Exemplary examples of compound (B) are shown below, but the compound is not limited to these examples.

(B1) $K_3[RhBr_6]$
(B2) $K_2[PdCl_4]$
(B3) $K_2[RuCl_5(NO)]$
(B4) $K_2[OSCl_6]$
(B5) $K_3[Co(CN)_6]$
(B6) $K_2[RuCl_5H_2O]$
(B7) $K_3[Ru_2Cl_8N(H_2O)_2]$
(B8) $K[OsO_3N]$
(B9) $K_3[RhCl_6]$
(B10) Phenisafranine
(B11) Pinakryptol yellow Compound (C) may be any iridium compound and is preferably a complex, which is coordinated with four or more halogen ligands.

Further, preferred compound (A) is represented by formula A and preferred compound (B) represented by formula B:

$$Y_{n1}M1(CN)_{n2}X_{n3} \qquad \text{formula A}$$

wherein M1 is a metal selected from the group consisting of iron, osmium and ruthenium; Y is a cation; X is a ligand; n1 is an integer of 0 to 4; n2 is an integer of 4 or more; and n3 is an integer of 0 to 2; and $$D_{n4}M2L_{n5}E_{n6} \qquad \text{formula B}$$

wherein M2 is a 8th group metal, except for iridium; D is a cation; L is a ligand selected from the group consisting of Cl and Br; E is a ligand; n4 is an integer of 0 to 2; n5 is an integer of 4 or more; and n6 is an integer of 0 to 2. Among exemplary compounds described above, more preferred compound (A) is selected from (A1), (A3) and (A4); and more preferred compound (B) is selected from (B1), (B3), (B4), (B6) and (B9).

In item 1. described above, the term "internally" is preferably an internal region of the grain at a depth of 0.001 μm or more from the grain surface. Examples of the compound forming an electron trap of a depth of 0.03 to 0.3 eV (a6) include Pb, Cd, a metal ion coordinating with a CN ligand, and a divalent metal ion, as described in "Shashinkogakuno Kiso (Ginenshashin-hen)" [Basic Photographic Engineering, (Silver salt photography)] at page 38, Table 2.5. In cases when forming a shallow electron trap at a depth of less than 0.03 eV, it proved difficult to obtain effects of the invention.

Examples of the compound forming an electron trap of a depth of not less than 0.6 eV (b6) include a rhodium compound and palladium compound, as also shown in the Table 2.5 described above. A deep electron trap level of a depth of not less than 0.6 eV is preferred, and the deeper, the more preferable. A compound forming an electron trap having a depth of not more than 0.3 eV is to be a compound corresponding to (a6) of compound (A).

The shallow electron trap capable of releasing a trapped electron in a time of less than 50 ns (or nano-second) described in (a4) is based on the fact that in cases of being not less than 50 ns, effects of the invention were not achieved. The deep electron trap capable of holding a trapped electron in a time of not less than 5 sec. described in (b4) is based on the fact that when being held in less than 5 sec., effects of the invention were also not achieved.

The expression "region doped with compound (C) and region doped with compound (B) being adjacent or crossed with each other in the grain" means that the compound (C)-doped region and the compound (B)-doped region are adjacent or are at least partially overlapped in the interior of the grain.

The boundary of the region doped with compound (A) that is nearest to the surface of the grain, as described in item 8. means that the boundary of the region which is doped with the compound (A) within a silver halide grain and which is located nearest to the grain surface. The region doped with compound (A) refers to a region in which the compound (A) is present in an effective amount to substantially express the intended effect. Herein, the effective amount to substantially express the intended effect is the range of $1\times10^{-8}$ to $1\times10^{-6}$ mol/mol Ag for compound (A) and $1\times10^{-10}$ to $1\times10^{-6}$ mol/mol Ag for compound (B) or compound (C).

In this case, the position of the boundary is expressed as the percentage of the grain volume. Thus, the boundary being located between 60 and 90% of the grain volume means that the boundary exists somewhere within the range between the position at the moment when the grain volume reaches 60% of the final grain volume and the position at the moment when the grain volume reaches 90% of the final grain volume. In this case, the center of the grain corresponds to 0% and the grain surface corresponds to 100%. In other words, the boundary is located at the position between the volume reached at the moment when 60 mol % of total silver was added during grain growth and the volume reached at the moment when 90 mol % of total silver was added. Accordingly, the boundary is preferably located between 60 to 90 mol %, based on silver of the grain. It means that the boundary exists somewhere within the range between the position corresponding to 60 mol % Ag and the position corresponding to 90 mol % Ag. In this case, when the silver amount of the grain is expressed as 100 mol %, the center of the grain is expressed as 0 mol %.

The region doped with compound (B) being internal to the region doped with compound (C) means that the at least a part of the compound (B)-doped region exists at the position nearer to the center of the grain than the compound (C)-containing region. In this case, it is preferred that the compound (B)-doped region and the compound (C)-doped region are adjacent or overlapped. Further, the compound (A)-doped region, the compound (B)-doped region and the compound (C)-doped region each preferably have a width of not more than 20 mol % (more preferably, 3 to 10 mol %), based on silver of the grain.

The metal valence number of a metal complex means the valence number of a metal ion contained in the metal complex. The metal valence number of $K_2IrCl_6$ complex, for example, indicates the valence number of iridium metal ion, that is, +4. The expression, three metal complexes different in metal valence number means three metal complexes, the metal valence numbers of which are, for example, +2,+3 or +4.

The expression that a region doped with a metal complex having a higher metal valence number is more interior than a region doped with a metal complex having the lowest metal valence number means that at least a part of the region doped a metal complex having a higher metal valence number is located at a deeper portion than the region doped with a metal complex having the lowest metal valence number. In this case, the metal complex having the lowest metal valence number indicates a metal complex having the lowest metal valence number among metal complexes doped in the grain.

Compounds (A) and (B), each is preferably a metal complex in terms of doping efficiency but is not necessarily limited to this. When compounds (A) and (B) are metal complexes, they are added to a silver halide emulsion in the form of their salts.

The iridium compound, rhodium compound and osmium compound to be doped in the grain each are preferably a compound having four or more halogen ligands. The iron compound to be doped in the grain is also preferably a compound having four or more cyano ligands. The rhodium compound- and osmium compound-doped region being more interior an iridium compound-doped region means that at least a part of the rhodium compound-doped region or osmium compound-doped region is located in a region nearer to the center of the grain than the iridium compound-doped region. In this case, it is preferred that the iridium compound-containing region is adjacent or overlap the rhodium compound-doped region or the osmium compound-containing region. The region containing a metal complex having a metal valence number of three or more being internal to the region doped with an iridium compound means that the region doped with the metal complex having a metal valence number of three or more is located at a position nearer to the center of the grain than the region doped the iridium compound.

The depth of an electron trap can be determined by measurement of microwave photoconduction. Thus, different depths of electron traps are expressed as a difference of signal intensities and a difference of decay times of the signal intensity. The signal intensity and the decay time of a deep electron trap are measured to be less than those of a shallow electron trap. Therefore, a compound forming a deep electron trap is measured to be less in signal intensity and its decay time than a compound forming a shallow electron trap. In this case, one of the compounds forming different electron traps in depth is preferably an iridium compound. The region containing a compound forming the deepest electron trap being internal to regions doped with the other two compounds means that at least a part of the region doped with a compound forming the deepest electron trap is located at a position nearer to the center of the grain, compared to the regions doped with the other two compounds. In this case, one of the other two compounds is preferably an iridium compound and the region doped with the iridium compound is preferably adjacent to or overlap the region doped with a compound forming the deepest electron trap.

Chemical sensitization process used in the invention is commonly known chemical sensitization with chalcogen sensitizers or noble metal sensitizers. Further, a silver halide emulsion used in the invention may be contained with heavy metal ions. Examples of heavy metals include the 8th to 10th group metals such as iron, iridium, platinum, palladium, nickel, rhodium, osmium, ruthenium, and cobalt; the 12th transition metals such as cadmium, zinc and mercury; rhenium, molybdenum, tungsten, gallium, and chromium.

To allow the above-described compound of the invention to occlude in the grains, the compound may be added at any stage before or during formation of silver halide grains, or during physical ripening after completion of grain formation. To obtain a silver halide emulsion meeting the requirements afore-mentioned, the compound may be dissolved together with a halide salt and added during the grain formation stage. The compound is added to a silver halide emulsion preferably in an amount of not less than $1\times10^{-9}$ mole and not more than $1\times10^{-2}$ mole per mole of silver halide, and more preferably not less than $1\times10^{-8}$ mole and not more than $5\times10^{-5}$ mol per mole of silver halide.

Silver halide grains usable in the invention may be any form. One of preferred forms is cubic grains having (100) crystal faces. Silver halide grains in an octahedral, tetradecahedral or dodecahedral form can be prepared according to the method described in U.S. Pat. No. 4,183,756 and 4,225,666, JP-A 55-26589, JP-B 55-42737 (herein the term, "JP-B" means an examined and published Japanese Patent) and J. Photogr. Sci. 21 39 (1973). Further, grains having twin plane(s) can be employed.

Monodisperse silver halide grains having a single form are preferred in the invention. Two or more monodisperse silver halide emulsions can be incorporated into a single layer.

A high bromide containing silver halide emulsion may be employed to obtain the silver halide emulsion according to the invention. In this case, a high bromide portion may be epitaxial junction to the silver halide grain or a part of the core/shell structure; alternatively, a region having different composition may be present without forming a complete layer. The halide composition may be continuously or discontinuously varied. The high bromide portion exists preferably at the corner of the grain. The silver halide grain size is preferably 0.1 to 1.2 $\mu$m, and more preferably 0.2 to 1.0 $\mu$m in terms of rapid processability and sensitivity. The grain form is not specifically limited.

With respect to grain size distribution of silver halide grains, monodisperse silver halide grain emulsion is preferred. Herein, the monodisperse silver halide emulsion is referred to as one having not more than 0.22 of a coefficient of variation A silver halide emulsion with a coefficient of variation of not more than 0.15 is more preferred. It is preferred that at least two kinds of monodisperse emulsions are incorporated into a single layer. The coefficient of variation, which indicates a width of the grain size distribution, is defined as follows:

$$\text{Coefficient of variation}=S/R$$

where S represents a standard deviation of grain size distribution and R represents an average grain size.

There can be employed a variety of apparatuses and methods for preparing silver halide emulsions, which are generally known in the art. The silver halide can be prepared according to any of acidic precipitation, neutral precipitation and ammoniacal precipitation. Silver halide grains can formed through a single process, or through forming seed grains and growing them. A process for preparing seed grains and a growing process thereof may be the same with or different from each other.

Normal precipitation, reverse precipitation, double jet precipitation or a combination thereof is applicable as a reaction mode of a silver salt and halide salt, and the double jet precipitation is preferred. As one mode of the double jet precipitation is applicable a pAg-controlled double jet method described in JP-A 54-48521. There can be employed a apparatus for supplying a silver salt aqueous solution and a halide aqueous solution through an adding apparatus provided in a reaction mother liquor, as described in JP-A 57-92523 and 57-92524; an apparatus for adding silver salt and halide solutions with continuously varying the concentration thereof, as described in German Patent 2,921,164; and an apparatus for forming grains in which a reaction mother liquor is taken out from the reaction vessel and concentrated by ultra-filtration to keep constant the distance between silver halide grains.

Solvents for silver halide such as thioethers are optionally employed. A compound containing a mercapto group, nitrogen containing heterocyclic compound or a compound such as a sensitizing dye can also be added at the time of forming silver halide grains or after completion thereof.

In the silver halide emulsion of the invention, sensitization with a gold compound and sensitization with a chalcogen sensitizer can be employed in combination. The chalcogen sensitizer include a sulfur sensitizer, selenium sensitizer and tellurium sensitizer and of these is preferred the sulfur sensitizer. Exemplary examples of sulfur sensitizers include thiosulfates, triethylthiourea, allylthiocarbamide, thiourea, allylisothiocyanate, cystine, p-toluenethiosulfonate, rhodanine, and sulfur single substance. The amount of the sulfur sensitizer to be added to a silver halide emulsion layer, depending of the kind of a silver halide emulsion and expected effects, is preferably $5\times10^{-10}$ to $5\times10^{-5}$, and more preferably $5\times10^{-9}$ to $3\times10^{-6}$ mole per mole of silver halide. In cases where added to a layer other than a silver halide emulsion layer, the amount is preferably $1\times10^{-9}$ to $1\times10^{-3}$ mole/m$^2$. The gold sensitizer such as chloroauric acid or gold sulfide is added in the form of a complex. Compounds, such as dimethylrhodanine, thiocyanic acid, mercaptotetrazole and mercaptotriazole are used as a ligand. The amount of the gold compound to be added, depending of the kind of a silver halide emulsion, the kind of the compound and ripening conditions, is preferably $1\times10^{-8}$ to $1\times10^{-4}$, and more preferably $1\times10^{-8}$ to $1\times10^{-5}$ mole per mole of silver halide. Silver halide emulsions used in the invention may be chemically sensitized by reduction sensitization.

A antifoggant or a stabilizer known in the art are incorporated into the photographic material, for the purpose of preventing fog produced during the process of preparing the photographic material, reducing variation of photographic performance during storage or preventing fog produced in development. Examples of preferred compounds for the purpose include compounds represented by formula (II) described in JP-A 2-146036 at page 7, lower column. These compounds are added in the step of preparing a silver halide emulsion, the chemical sensitization step or during the course of from completion of chemical sensitization to preparation of a coating solution. In cases when chemical sensitization is undergone in the presence of these compounds, the amount thereof is preferably $1\times10^{-5}$ to $5\times10^{-4}$ mole per mole of silver halide. In cases when added after chemical sensitization, the amount thereof is preferably $1\times10^{-6}$ to $1\times10^{-2}$, and more preferably $1\times10^{-5}$ to $5\times10^{-3}$ mol per mole of silver halide. In cases when added at the stage of preparing a coating solution, the amount is preferably $1\times10^{-6}$ to $1\times10^{-1}$, and more preferably $1\times10^{-5}$ to $1\times10^{-2}$ mole per mol of silver halide. In case where added to a layer other than a silver halide emulsion layer, the amount is preferably 1×10–9 to $1\times10^{-3}$ mole/m$^2$.

There are employed dyes having absorption at various wavelengths for anti-irradiation and anti-halation in the photographic material relating to the invention. A variety of dyes known in the art can be employed, including dyes having absorption in the visible range described in JP-A 3-251840 at page 308, AI-1 to 11, and JP-A 6-3770; infrared absorbing dyes described in JP-A 1-280750 at page 2, left. lower column, formula (I), (II) and (III). These dyes do not adversely affect photographic characteristics of a silver halide emulsion and there is no stain due to residual dyes. For the purpose of improving sharpness, the dye is preferably added in an amount that gives a reflection density at 680 nm of not less than 0.7 and more preferably not less than 0.8.

Fluorescent brightening agents are also incorporated into the photographic material to improve whiteness. Examples of preferred compounds include those represented by formula II described in JP-A 2-232652.

In cases when a silver halide photographic light sensitive material according to the invention is employed as a color photographic material, the photographic material comprises layer(s) containing silver halide emulsion(s) which are spectrally sensitized in the wavelength region of 400 to 900 nm, in combination with a yellow coupler, a magenta coupler and a cyan coupler. The silver halide emulsion contains one or more kinds of sensitizing dyes, singly or in combination thereof.

In the silver halide emulsions can be employed a variety of spectral-sensitizing dyes known in the art. Compounds BS-1 to 8 described in JP-A 3-251840 at page 28 are preferably employed as a blue-sensitive sensitizing dye. Compounds GS-1 to 5 described in JP-A 3-251840 at page 28 are preferably employed as a green-sensitive sensitizing dye. Compounds RS-1 to 8 described in JP-A 3-251840 at page 29 are preferably employed as a red-sensitive sensitizing dye. In cases where exposed to infra-red ray with a semiconductor laser, infrared-sensitive sensitizing dyes are employed. Compounds IRS-1 to 11 described in JP-A 4–285950 at pages 6–8 are preferably employed as a blue-sensitive sensitizing dye. Supersensitizers SS-1 to SS-9 described in JP-A 4-285950 at pages 8–9 and compounds S-1 to S-17 described in JP-A 5-66515 at pages 5–17 are preferably included, in combination with these blue-sensitive, green-sensitive and red-sensitive sensitizing dyes. The sensitizing dye is added at any time during the course of silver halide grain formation to completion of chemical sensitization. The sensitizing dye is incorporated through solution in water-miscible organic solvents such as methanol, ethanol, fluorinated alcohol, acetone and dimethylformamide or water, or in the form of a solid particle dispersion.

As couplers used in silver halide photographic materials relating to the invention is usable any compound capable of forming a coupling product exhibiting an absorption maximum at the wavelength of 340 nm or longer, upon coupling with an oxidation product of a developing agent. Representative examples thereof include yellow dye forming couplers exhibiting an absorption maximum at the wavelength of 350 to 500 nm, magenta dye forming couplers exhibiting an absorption maximum at the wavelength of 500 to 600 nm and cyan dye forming couplers exhibiting an absorption maximum at the wavelength of 600 to 750 nm.

Examples of preferred cyan couplers include those which are represented by general formulas (C-I) and (C-II) described in JP-A 4-114154 at page 5, left lower column. Exemplary compounds described therein (page 5, right lower column to page 6, left lower column) are CC-1 to CC-9.

Examples of preferred magenta couplers include those which are represented by general formulas (M-I) and (M-II) described in JP-A 4-114154 at page 4, right upper column. Exemplary compounds described therein (page 4, left lower column to page 5, right upper column) are MC-1 to MC-11. Of these magenta couplers are preferred couplers represented by formula (M-I) described in ibid, page 4, right upper column; and couplers in which RM in formula (M-I) is a tertiary alkyl group are specifically preferred. Further, couplers MC-8 to MC-11 are superior in color reproduction of blue to violet and red, and in representation of details.

Examples of preferred yellow couplers include those which are represented by general formula (Y-I) described in JP-A 4-114154 at page 3, right upper column. Exemplary compounds described therein (page 3, left lower column) are YC-1 to YC-9. Of these yellow couplers are preferred couplers in which RY1 in formula (Y-I) is an alkoxy group are specifically preferred or couplers represented by formula [I] described in JP-A6-67388. Specifically preferred examples thereof include YC-8 and YC-9 described in JP-A 4-114154 at page 4, left lower column and Nos. (1) to (47) described in JP-A6-67388 at pages 13–14. Still more preferred examples include compounds represented by formula [Y-1] described in JP-A 4-81847 at page 1 and pages 11–17.

When an oil-in-water type-emulsifying dispersion method is employed for adding couplers and other organic compounds used for the photographic material of the present invention, in a water-insoluble high boiling organic solvent, whose boiling point is 150° C. or more, a low boiling and/or a water-soluble organic solvent are combined if necessary and dissolved. In a hydrophilic binder such as an aqueous gelatin solution, the above-mentioned solutions are emulsified and dispersed by the use of a surfactant. As a dispersing means, a stirrer, a homogenizer, a colloidal mill, a flow jet mixer and a supersonic dispersing machine may be used. Preferred examples of the high boiling solvents include phthalic acid esters such as dioctyl phthalate, diisodecyl phthalate, and dibutyl phthalate; and phosphoric acid esters such as tricresyl phosphate and trioctyl phosphate. High boiling solvents having a dielectric constant of 3.5 to 7.0 are also preferred. These high boiling solvents may be used in combination. Instead of or in combination with the high boiling solvent is employed a water-insoluble and organic solvent-soluble polymeric compound, which is optionally dissolved in a low boiling and/or water-soluble organic solvent and dispersed in a hydrophilic binder such as aqueous gelatin using a surfactant and various dispersing means. In this case, examples of the water-insoluble and organic solvent-soluble polymeric compound include poly(N-t-butylacrylamide).

As a surfactant used for adjusting surface tension when dispersing or coating photographic additives, the preferable compounds are those containing a hydrophobic group having 8 through 30 carbon atoms and a sulfonic acid group or its salts in a molecule. Exemplary examples thereof include A-1 through A-11 described in JP-A No. 64-26854. In addition, surfactants, in which a fluorine atom is substituted to an alkyl group, are also preferably used. The dispersion is conventionally added to a coating solution containing a silver halide emulsion. The elapsed time from dispersion until addition to the coating solution and the time from addition to the coating solution until coating are preferably short. They are respectively preferably within 10 hours, more preferably within 3 hours and still more preferably within 20 minutes.

To each of the above-mentioned couplers, to prevent color fading of the formed dye image due to light, heat and humidity, an anti-fading agent may be added singly or in combination. The preferable compounds or a magenta dye are phenyl ether type compounds represented by Formulas I and II in JP-A No. 2-66541, phenol type compounds represented by Formula IIIB described in JP-A No. 3-174150, amine type compounds represented by Formula A described in JP-A No. 64-90445 and metallic complexes represented by Formulas XII, XIII, XIV and XV described in JP-A No. 62-182741. The preferable compounds to form a yellow dye and a cyan dye are compounds represented by Formula I, described in JP-A No. 1-196049 and compounds represented by Formula II described in JP-A No. 5-11417.

A compound (d-11) described in JP-A 4-114154 at page 9, left lower column and a compound (A'-1) described in the same at page 10, left lower column are also employed for allowing the absorption wavelengths of a dye to shift. Besides can also be employed a compound capable of releasing a fluorescent dye described in U.S. Pat. No. 4,774,187.

It is preferable that a compound reacting with the oxidation product of a color developing agent be incorporated into a layer located between light-sensitive layers for preventing color staining and that the compound is added to the silver halide emulsion layer to decrease fogging. As a compound for such purposes, hydroquinone derivatives are preferable, and dialkylhydroquinone such as 2,5-di-t-octyl hydroquinone are more preferable. The specifically preferred compound is a compound represented by Formula II described in JP-A No. 4-133056, and compounds II-1 through II-14 described in the above-mentioned specification pp. 13 through 14 and compound 1 described on page 17.

In the photographic material according to the present invention, it is preferable that static fogging is prevented and light-durability of the dye image is improved by adding a UV absorber. The preferable UV absorber is benzotriazoles. The specifically preferable compounds are those represented by Formula III-3 in JP-A No. 1-250944, those represented by Formula III described in JP-A No. 64-66646, UV-1L through UV-27L described in JP-A No. 63-187240, those represented by Formula I described in JP-A No. 4-1633 and those represented by Formulas (I) and (II) described in JP-A No. 5-165144.

In the photographic materials used in the invention is advantageously employed gelatin as a binder. Furthermore, there can be optionally employed other hydrophilic colloidal materials, such as gelatin derivatives, graft polymers of gelatin with other polymers, proteins other than gelatin, saccharide derivatives, cellulose derivatives and synthetic hydrophilic polymeric materials. A vinylsulfone type hardening agent or a chlorotriazine type hardening agent is employed as a hardener of the binder, and compounds described in JP-A 61-249054 and 61-245153 are preferably employed. An antiseptic or antimold described in JP-A 3-157646 is preferably incorporated into a hydrophilic colloid layer to prevent the propagation of bacteria and mold which adversely affect photographic performance and storage stability of images. A lubricant or a matting agent is also preferably incorporated to improve surface physical properties of raw or processed photographic materials.

A variety of supports are employed in the photographic material used in the invention, including paper coated with polyethylene or polyethylene terephthalate, paper support made from natural pulp or synthetic pulp, polyvinyl chloride sheet, polypropylene or polyethylene terephthalate supports which may contain a white pigment, and baryta paper. Of these supports a paper support coated, on both sides, with water-proof resin layer. As the water-proof resin are preferably employed polyethylene, ethylene terephthalate and a copolymer thereof. Inorganic and/or organic white pigments are employed, and inorganic white pigments are preferably employed. Examples thereof include alkaline earth metal sulfates such as barium sulfate, alkaline earth metal carbonates such as calcium carbonate, silica such as fine powdery silicate and synthetic silicate, calcium silicate, alumina, alumina hydrate, titanium oxide, zinc oxide, talc, and clay. Preferred examples of white pigments include barium sulfate and titanium oxide. The amount of the white pigment to be added to the water-proof resin layer on the support surface is preferably not less than 13% by weight, and more preferably not less than 15% by weight to improve sharpness. The dispersion degree of a white pigment in the water-proof resin layer of paper support can be measured in accordance with the procedure described in JP-a 2-28640. In this case, the dispersion degree, which is represented by a coefficient of variation is preferably not more than 020, and more preferably not more than 0.15.

Supports having a center face roughness (Sra) of 0.15 nm or less (preferably, 0.12 nm or less) are preferably employed in terms of glossiness. Trace amounts of a blueing agent or reddening agent such as ultramarine or oil-soluble dyes are incorporated in a water-proof resin layer containing a white pigment or hydrophilic layer(s) of a reflection support to adjust the balance of spectral reflection density in a white portion of processed materials and improve its whiteness. The surface of the support may be optionally subjected to corona discharge, UV light exposure or flame treatment and further thereon, directly or through a sublayer (i.e., one or more sublayer for making improvements in surface properties of the support, such as adhesion property, antistatic property, dimensional stability, friction resistance, hardness, anti halation and/or other characteristics), are coated component layers of the photographic material relating to the invention. In coating of the photographic material, a thickening agent may be employed to enhance coatability of a coating solution. As a coating method are useful extrusion coating and curtain coating, in which two or more layers are simultaneously coated.

To form photographic images using a photographic material relating to the invention, an image recorded on the negative can optically be formed on a photographic material to be printed. Alternatively, the image is converted to digital information to form the image on a CRT (anode ray tube), and the resulting image can be formed on a photographic material to be printed by projecting or scanning with varying the intensity and/or exposing time of laser light, based on the digital information.

It is preferable to apply the present invention to a photographic material wherein a developing agent is not incorporated in the photographic material. Specifically, it is preferable to apply the present invention to the photographic material having a reflective support to form an image for direct visual stimulation. Examples thereof include color paper, color reversal paper, positive image forming photographic materials, photographic materials for display and photographic materials for color proofs.

Commonly known aromatic primary amine developing agents are employed in the invention. Examples thereof include:

CD-1) N,N-diethyl-p-phenylendiamine,

CD-2) 2-amino-5-diethylaminotoluene,

CD-3) 2-amino-5-(N-ethyl-N-laurylamino)toluene,

CD-4) 4-(N-ethyl-N-(β-hydroxyethyl)amino)-aniline,

CD-5) 2-methyl-4-(N-ethyl-N-(β-hydroxyethyl)amino) aniline,

CD-6 4-amino-3-methyl-N-ethyl-N-(β-methanesulfoneamido)-ethyl) aniline,

CD-7) N-(2-amino-5-diethylaminophenylethyl)-methanesulfonamide,

CD-8) N,N-dimethyl-p-phenylenediamine,

CD-9) 4-amino-3-methyl-N-ethyl-N-metoxyethylaniline,

CD-10) 4-amino-3-methyl-N-ethyl-N-(β-ethoxyethyl) aniline,

CD-11) 4-amino-3-methyl-N-ethyl-N-(-γ-hydroxypropyl) aniline.

The pH of a color developing solution is optional, but preferably 9.5 to 13.0, and more preferably 9.8 to 12.0 in terms of rapid access. The higher color development temperature enables more rapid access, but the temperature is preferably 35 to 70° C., and more preferably 37 to 60° C. in terms of stability of processing solutions. The color developing time is conventionally 3 min. 30 sec. but the developing time in the invention is preferably not longer than 40 sec., and more preferably not longer than 25 sec.

In addition to the developing agents described above, the developing solution is added with commonly known developer component compounds, including an alkaline agent having pH-buffering action, a development inhibiting agent such as chloride ion or benzotriazole, a preservative, and a chelating agent.

In the image forming method according to the invention, photographic materials, after color-developed, may be optionally subjected to bleaching and fixing. The bleaching and fixing may be carried out currently. After fixing, washing is conventionally carried out. Stabilizing may be conducted in place of washing. As a processing apparatus used in the invention is applicable a roller transport type processor in which a photographic material is transported with being nipped by rollers and an endless belt type processor in which a photographic material is transported with being fixed in a belt. Further thereto are also employed a method in which a processing solution supplied to a slit-formed processing bath and a photographic material is transported therethrough, a spraying method, a web processing method by contact with a carrier impregnated with a processing solution and a method by use of viscous processing solution. A large amount of photographic materials are conventionally processed using an automatic processor. In this case, the less replenishing rate is preferred and an environmentally friendly embodiment of processing is replenishment being made in the form of a solid tablet, as described in KOKAI-GIHO (Disclosure of Techniques) 94-16935.

EXAMPLES

The present invention will be further explained based on examples, but embodiments of the invention are not limited to these.

Example 1

Preparation of Silver Halide Emulsion (E-1)

To 1 liter of aqueous 2% gelatin solution kept at 40° C. were simultaneously added the following solutions A and B in 20 min., while being maintained at a pAg of 7.3 and pH of 3.0, and further thereto were added Solutions C and D in 120 min., while being maintained at a pAg of 8.0 and pH of 5.5. The pAg was controlled by the method described in JP-A 59-45437, and the pH was adjusted using aqueous sulfuric acid or sodium hydroxide solution.

| | |
|---|---|
| Solution A | |
| Sodium chloride | 0.48 g |
| Potassium bromide | 0.004 g |
| Water to make | 28 ml |
| Solution B | |
| Silver nitrate | 1.4 g |
| Water to make | 28 ml |
| Solution C | |
| Sodium chloride | 129.4 g |
| Potassium bromide | 0.133 g |
| Water to make | 661 ml |
| Solution D | |
| Silver nitrate | 376.6 g |
| Water to make | 661 ml |

After completing the addition, the resulting emulsion was desalted using a 5% aqueous solution of Demol N (produced by Kao-Atlas) and aqueous 20% magnesium sulfate solution, and redispersed in a gelatin aqueous solution to obtain a monodisperse cubic grain emulsion (E-1) having an average grain size of 0.40 μm, a coefficient of variation of grain size of 0.08 and a chloride content of 99.5 mol %.

Emulsions E-2 to E-6 were also prepared in a manner similar to emulsion E-1, except that a compound as shown in Table 1 was added to solutions A and C so as to be homogeneously distributed within the grain. In this case, compound (A) was added in an amount of 1×10−5 mole/Ag mole; and Compound (B) or (C) was added in an amount of 1×10−8 mole/Ag mole. Timing of addition was the same as in E-1. Using each of the emulsions E-1 to E-6, samples were prepared in accordance with JP-A 10-186558 and the photoconduction signal intensity and the decay time thereof were determined. The photoconduction signal intensity and its decay time were represented by a relative value, based on the photoconduction signal intensity and its decay time of emulsion E-1 each being 100. Results thereof are shown in Table 1.

TABLE 1

| Emulsion | Compound (mole/Ag mol) | Intensity | Decay Time | Depth of Trap (eV) |
|---|---|---|---|---|
| E-1 | — | 100 | 100 | — |
| E-2 | C1* ($1 \times 10^{-8}$) | 92 | 89 | — |
| E-3 | A1 ($1 \times 10^{-5}$) | 220 | 500 | 0.07–0.3 |
| E 4 | B1 ($1 \times 10^{-8}$) | 45 | 48 | 0.8 |
| E-5 | B2 ($1 \times 10^{-8}$) | 86 | 83 | 0.6 |
| E-6 | A2 ($1 \times 10^{-5}$) | 103 | 120 | 0.05 |

*(A1) $K_4Fe(CN)_6$, (A2) $CdCl_2$, (B1) $K_3RhBr_6$, (B2) $K_2PdCl_4$, (C1) $K_2IrCl_6$

From results of photoconduction signal intensity and its decay time in Table 1, it can be judged that each compound corresponds any one of the compounds of the invention.

Preparation of Green-sensitive Silver Halide Emulsion (E2-1)

Emulsion E-1 was subjected to chemical ripening at 60° C. for 120 min. to obtain green-sensitive silver halide emulsion E2-1, in which the pH and pAg was adjusted to 5.6 and 35. Similarly, emulsions E-2 to E-6 each were chemically ripened to obtain emulsion E"-2 to E"-6.

| Additive | Amount |
|---|---|
| 1. Sensitizing dye GS-1 | $4 \times 10^{-4}$ mol/AgX mol |
| 2. Stabilizer STAB-1* | $1 \times 10^{-4}$ mol/AgX mol |
| 3. Sodium thiosulfate | 0.4 mg/AgX mol |
| 4. Chloroauric acid | 2.4 mg/AgX mol |

*: 1-(3-acetoamidophenyl)-5-mercaptotetrazole

GS-1

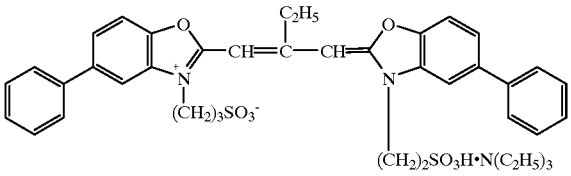

Preparation of Coating Sample

On a paper support laminated with polyethylene on one side thereof and polyethylene containing titanium oxide on another side thereof (on which photographic component layers were coated), the following layers were coated to prepare photographic material Sample 1.

TABLE 2

| Layer | Additive | Amount (g/m$^2$) |
|---|---|---|
| 2nd layer | Gelatin | 1.0 |
| | E2-1 | 0.36 (Amount converted to silver) |
| | Magenta coupler (M-1) | 0.35 |
| 1st layer (green-sensitive layer) | Image stabilizer (ST-3) | 0.15 |
| | do (ST-4) | 0.15 |
| | do (ST-5) | 0.15 |
| | TOP | 0.2 |
| Support | Polyethylene-laminated paper | |

Further, hardener H-1 was added to the 2$^{nd}$ layer.

M-1

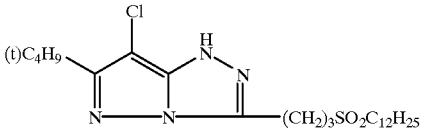

ST-3: 1,4-dibutoxy-2,5-di-t-butylbenzene
ST-4: 4-(4-hexyloxyphenyl)thiomorpholine-1-dioxide
ST-5: 1,1-bis(2-methyl-4-hydroxy-5-t-butylphenyl)butane
TOP: trioctylphosphate
H-1: 2,4-dichloro-6-hydroxy-s-triazine sodium salt Samples 2 to 6 were similarly prepared, except that emulsion E2-1 was replaced by emulsions E2-2 to E2-6.

Emulsions E-7 to E-12 were prepared similarly to E-2, provided that compounds as shown in Table 3 were added to solution A and C. Further, emulsion E-7 to E-12 were chemically ripened similarly to E2-1 to obtain emulsions E-7 to E2-12. Furthermore, photographic material Samples 7 to 12 were prepared similarly to Sample 1, as shown in Table 3, except that emulsion E2-1 was replaced by E2-7 to E2-12.

Samples thus Prepared were Evaluated as Follow

Sensitivity and Contrast (γ)

Samples were each exposed to white light through an optical wedge for a period of 0.05 sec. and processed according to the following steps. Thereafter, samples thus processed were subjected to densitometry using densitometer PDA type 65 (available from Konica Corp.). Sensitivity was represented by a relative value of a logarithmic reciprocal of exposure necessary to give a density of fog density plus 0.8, based on the sensitivity of Sample 1 being 100. Contrast (γ) was represented by a relative value of a reciprocal of the difference between the logarithmic exposure giving a density of fog density plus 0.8 and exposure giving a density of fog density plus 1.8, based on the contrast of Sample 1 being 100.

Humidity Dependence at the Time of Exposure

After being allowed to stand in an atmosphere at room temperature and 30% RH (Relative Humidity) over a period of 1 hr., samples each were exposed to white light in the same atmosphere and evaluated with respect to sensitivity in a similar manner as described above. Samples were also similarly evaluated with respect to sensitivity, provided that samples were allowed to stand in an atmosphere of 23° C. and 80% RH. To evaluate variation of sensitivity with humidity, sensitivity of a sample aged at 80% RH was represented by a relative value, based on the sensitivity of a sample aged at 30% RH being 100.

Latent Image Stability

Samples which were processed 10 sec. after exposure to white light, and samples which were processed 5 min. after exposure, were respectively subjected to densitometry using densitometer PDA type 65 (available from Konica Corp.). Latent image stability was evaluated based on a difference (Δγ) between contrast at processing 10 sec. after exposure (γ1) and contrast at processing 5 min. after exposure (γ2):

$$(\Delta\gamma)=\gamma 1-\gamma 2$$

where γ is a reciprocal of exposure between logarithmic exposure giving a density of fog density plus 0.1 and logarithmic exposure giving a density of fog density plus 0.6.

Processing

| Step | Temperature | Time | Replenishing |
|---|---|---|---|
| Color developing | 38.0 ± 0.3° C. | 45 sec | 80 cc |
| Bleach-fixing | 35.0 ± 0.5° C. | 45 sec | 120 cc |
| Stabilizing | 30–34° C. | 60 sec | 150 cc |
| Drying | 60–80° C. | 30 sec | |

Color developing solution

| | Worker | Replenisher |
|---|---|---|
| Water | 800 cc | 800 cc |
| Triethylene diamine | 2 g | 3 g |
| Diethylene glycol | 10 g | 10 g |
| Potassium bromide | 0.01 g | — |

-continued

| Color developing solution | Worker | Replenisher |
|---|---|---|
| Potassium chloride | 3.5 g | — |
| Potassium sulfite | 0.25 g | 0.5 g |
| N-ethyl-(β-methanesulfonamidoethyl)-3-methyl-4-aminoaniline sulfate | 6.0 g | 10.0 g |
| N,N-diethylhydroxyamine | 6.8 g | 6.0 g |
| Triethanolamine | 10.0 g | 10.0 g |
| Sodium diethylenetriamine-pentaacetate | 2.0 g | 2.0 g |
| Brightener (4,4'-diaminostilbene sulfonic acid derivative | 2.0 g | 2.5 g |
| Potassium carbonate | 30 g | 30 g |

Water is added to make a total volume of 1 liter and the pH of the worker and replenisher was adjusted to 10.10 and 10.60, respectively, with potassium carbonate or glacial acetic acid.

| Bleach-fixing solution and replenisher solution | |
|---|---|
| Ammonium ferric diethylenetriaminepentaacetate dihydride | 65 g |
| Diethylenetriaminepentaacetic acid | 3 g |
| Ammonium thiosulfate (70% aq. solution) | 100 ml |
| 2-Amino-5-mercapto-1,3,4-thiadiazole | 2.0 g |
| Ammonium sulfite (40% aq. solution) | 27.5 ml |

Water was added to make 1 liter and the pH was adjusted to 6.5 with potassium carbonate or glacial acetic acid.

| Stabilizing solution and replenisher solution | |
|---|---|
| o-Phenylphenol | 1.0 g |
| 5-Chloro-2-methyl-4-isothiazoline-3-one | 0.02 g |
| 2-Methyl-4-isothiazoline-3-one | 0.02 g |
| Diethylene glycol | 1.0 g |
| Brightener (Chinopal SFP) | 2.0 g |
| 1-Hydroxyethylidene-1,1-diphosphonic acid | 1.8 g |
| Bismuth chloride (aqueous 45%) | 0.65 g |
| Magnesium sulfate heptahydrate | 0.2 g |
| Polyvinyl pyrrolidine (PVP) | 1.0 g |
| Ammonia water (aqueous 25% ammonium hydroxide) | 2.5 g |
| Trisodium nitrilotriacetate | 1.5 g |

Water was added to make 1 liter and the pH was adjusted to 7.5 with sulfuric acid or ammonia water.

TABLE 3

| Sample | Emulsion | Compound | Sensitivity | γ | Humidity Dependence | latent Image Stability | Remark |
|---|---|---|---|---|---|---|---|
| 1 | E2-1 | — | 100 | 100 | 135 | 103 | Comp. |
| 2 | E2-2 | C1* | 81 | 172 | 132 | 125 | Comp. |
| 3 | E2-3 | A1 | 131 | 83 | 131 | 105 | Comp. |
| 4 | E2-4 | B1 | 43 | 221 | 120 | 103 | Comp. |
| 5 | E2-5 | B2 | 69 | 119 | 127 | 107 | Comp. |
| 6 | E2-6 | A2 | 105 | 89 | 126 | 103 | Comp. |
| 7 | E2-7 | C1, B1 | 37 | 235 | 133 | 123 | Comp. |
| 8 | E2-8 | A1, B1 | 80 | 202 | 130 | 104 | Comp. |
| 9 | E2-9 | C1, A1 | 100 | 189 | 135 | 135 | Comp. |
| 10 | E2-10 | C1, A1, B1 | 95 | 178 | 112 | 110 | Inv. |
| 11 | E2-11 | C1, A2, B1 | 93 | 159 | 114 | 112 | Inv. |
| 12 | E2-12 | C1, A1, B2 | 105 | 152 | 115 | 111 | Inv. |

*(A1) $K_4Fe(CN)_6$, (A2) $CdCl_2$, (B1) $K_3RhBr_6$, (B2) $K_2PdCl_4$, (C1) $K_2IrCl_6$

As can be seen from Tables 1 and 3, it was proved that inventive Samples exhibited little reduction in sensitivity, leading to improvements in humidity dependence, while maintaining suitable contrast (close to 150). The latent image stability was also suitably improved. Specifically, Sample 10 exhibited superior results with respect to humidity dependence and latent image stability.

Example 2

Emulsions E2-13 to E2-18 were prepared in a manner similar to emulsion E2-10, except that addition of compound (A1), (B1) or (C1) was varied, as shown in Table 4. The addition amount of each compound was the same as in Example 1. Each compound was added so that the compound was homogeneously doped in the grain between the center of the grain and the position at which addition of the compound was completed. As shown in the Table, the position of the doped compound in the emulsion grains is expressed as the percentage of the grain volume reached at the moment where the addition of the compound started and the percentage of the grain volume at the moment where the addition of the compound is stopped. In emulsion E2–10, for example, compounds (A1), (B1) and (C1) each were homogeneously doped in the grain between 0 and 100% of the grain volume. In this case, the percentage is expressed in mol %, based on silver, and 0% and 100% correspond to the center of the grain and the grain surface, respectively. Using these emulsions, photographic material samples were prepared similarly to Sample 10 and evaluated in a manner similar to Example 1. Results thereof are shown in Table 5.

TABLE 4

| Emulsion | Addition Position (Ag mol %) (A1) | (B1) | (C1) | Distance* (μm) |
|---|---|---|---|---|
| E2-10 | 0-100 | 0-100 | 0-100 | A1: 0. B1: 0.0000 |
| E2-13 | 0-98 | 0-100 | 0-100 | A1: 0.0013 |
| E2-14 | 0-80 | 0-100 | 0-100 | A1: 0.0143 |
| E2-15 | 0-50 | 0-100 | 0-100 | A1: 0.0413 |
| E2-16 | 0-100 | 0-100 | 0-98 | C1: 0.0013 |
| E2-17 | 0-100 | 0-100 | 0-80 | C1: 0.0143 |
| E2-18 | 0-100 | 0-100 | 0-50 | C1: 0.0413 |

*Shortest distance of from the grain surface to the compound-containing position

TABLE 5

| Sample | Emulsion | Sensitivity | Humidity Dependence | Latent Image Stability | γ |
|---|---|---|---|---|---|
| 10 | E2-10 | 95 | 112 | 110 | 178 |
| 13 | E2-13 | 93 | 110 | 108 | 185 |
| 14 | E2-14 | 92 | 108 | 106 | 168 |
| 15 | E2-15 | 85 | 107 | 106 | 171 |
| 16 | E2-16 | 98 | 108 | 108 | 182 |
| 17 | E2-17 | 101 | 106 | 105 | 170 |
| 18 | E2-18 | 105 | 110 | 105 | 193 |

As can be seen from Table 5, the location of doping the compound (A1) was the most advantageous in emulsion E2-14 with the compound (A1) located in the grain up to 80% of grain volume, in terms of sensitivity, contrast γ, humidity dependence and latent image stability. Further from Sample 17, the location of the doped compound (C1) was similar.

Example 3

Emulsions E2-19 to E2-24 were prepared in a manner similar to emulsion E2-10, except that addition of compound (A1), (B1) or (C1) was varied, as shown in Table 6. Using these emulsions, photographic material samples were prepared similarly to Sample 10 and evaluated in a manner similar to Example 1. Results there of are shown in Table 7. The addition amount of each compound was the same as in Example 1.

TABLE 6

| | Addition position (Ag mol %) | | |
|---|---|---|---|
| Emulsion | (A1) | (B1) | (C1) |
| E2-19 | 50–80 | 50–80 | 0–50 |
| E2-20 | 50–80 | 0–50 | 50–80 |
| E2-21 | 0–50 | 50–80 | 50–80 |
| E2-22 | 70–80 | 0–70 | 70–80 |
| E2-23 | 50–80 | (B3):(0–50)* | 50–80 |
| E2-24 | 50–80 | (B4):(0–50)* | 50–80 |

*(B1) was not added
(A1) $K_4Fe^{II}(CN)_6$
(B1) $K_3Rh^{III}Br_6$,
(B3) $K_2Ru^{II}C1_5(NO)$
(B4) $K_2Os^{IV}Cl_6$
(C1) $K_2Ir^{IV}Cl_6$

TABLE 7

| Sample | Emulsion | Sensitivity | Humidity Dependence | Latent Image Stability | γ |
|---|---|---|---|---|---|
| 19 | E2-19 | 100 | 107 | 105 | 118 |
| 20 | E2-20 | 105 | 103 | 103 | 158 |
| 21 | E2-21 | 80 | 109 | 105 | 182 |
| 22 | E2-22 | 108 | 101 | 101 | 154 |
| 23 | E2-23 | 100 | 106 | 103 | 168 |
| 24 | E2-24 | 109 | 101 | 101 | 153 |

As shown in Table 7, from comparison of Samples 19 and 20, it is shown that the location of compound (B) being more interior than that of compound (C) is preferred in terms of contrast (γ) and thereby other performance such as humidity dependence is preferred. From comparison of Sample 20 and 21, the location of compound (A) being more exterior than that of compound (B) is preferred in terms of sensitivity and thereby other performance such as humidity dependence is preferred. From comparison of Samples 20, 21 and 23, when the region containing a complex of a metal having a higher valence number is located nearer to the grain center than the region containing a complex of a metal having the lowest valence number (Samples 20 and 23), it is preferred in terms of sensitivity and humidity dependence. In this case, the higher valence number is more preferred. From comparison of Samples 20 and 22, the doping region of the compound (A) or (C) is the less (Sample 22), the more preferable.

From the results of Sample 24, it was proved that the constitution described in item 17. was superior. The superior results of Samples 20, 22 and 24 to Samples 19 and 21 proves that the constitution described in item 18. is superior.

Example 4

Emulsions E2-25 to E2-28 were prepared in a manner similar to emulsion E2-10, except that addition of compound (A1), (B1) or (C1) was varied, as shown in Table 8. Using these emulsions, photographic material samples were prepared similarly to Sample 10 and evaluated in a manner similar to Example 1. Results there of are shown in Table 9. The addition amount of each compound was the same as in Example 1.

TABLE 8

| | Addition position (Ag mol%) | | |
|---|---|---|---|
| Emulsion | (A1) | (B1) | (C1) |
| E2-25 | 70–75 | 55–60 | 75–80 |
| E2-26 | 65–70 | 60–65 | 75–80 |
| E2-27 | 70–75 | 65–70 | 75–80 |
| E2-28 | 75–80 | 60–65 | 65–70 |

TABLE 9

| Sample | Emulsion | Sensitivity | Humidity Dependence | Latent Image Stability | γ |
|---|---|---|---|---|---|
| 25 | E2-25 | 105 | 105 | 106 | 129 |
| 26 | E2-26 | 95 | 107 | 105 | 142 |
| 27 | E2-27 | 103 | 103 | 102 | 151 |
| 28 | E2-28 | 107 | 108 | 104 | 146 |

As apparent from Table 9, Sample 27 led to superior results in humidity dependence and latent image stability, as compared to Samples 25, 26 and 28. Thus, as described in items 5, and 6., the regions containing compounds (A), (B) and (C) are adjacent or crossed with each other.

What is claimed is:

1. A silver halide emulsion containing silver halide grains having a chloride content of not less than 90 mol %, the silver halide grains each being internally doped with compound (A), compound (B) and compound (C), wherein: said compound (A) is selected from the group consisting of $K_4Fe(CN)_6$, $K_4Ru(CN)_6$ and $K_4OS(CN)_6$; said compound (B) is selected from the group consisting of $K_3RhBr_6$, $K_2OsCl_6$, $K_2RuCl_5$ $(H_2O)$ and $K_3RhCl_6$; and compound (C) is an iridium compound.

2. The silver halide emulsion of claim 1, wherein said silver halide grains each are internally doped with compound (A) and exhibiting an intensity of a microwave photoconduction signal, a decay time of a microwave photoconduction signal intensity or a sensitivity of at least two times that of silver halide grains which are not doped with compound (A).

3. The silver halide emulsion of claim 1, wherein said silver halide grains each are internally doped with compound (B) and exhibiting an intensity of a microwave photoconduction signal, a decay time of a microwave photoconduction signal intensity or a sensitivity of not more than ½ times that of silver halide grains which are not doped with compound (B).

4. The silver halide emulsion of claim 1, wherein said silver halide grains each contain a region doped with compound (C) and a region doped with compound (B), said region doped with compound (C) and said region doped with compound (B) being adjacent or overlapping each other in the grain.

5. The silver halide emulsion of claim 1, wherein said silver halide grains each contain a region doped with compound (C) and a region doped with compound (A), said region doped with compound (C) and region doped with compound (A) being adjacent or overlapping each other in the grain.

6. The silver halide emulsion of claim 1, wherein said silver halide grains each contain a region doped with compound (A) and a region doped with compound (B), said region doped with compound (A) and region doped with compound (B) being adjacent or crossed with each other in the grain.

7. The silver halide emulsion of claim 1, wherein said silver halide grains each contain a region doped with compound (A) in the grain and the boundary of the region doped with compound (A) that is nearest to the surface of the grain is located at a depth of 0.01 to 0.035 $\mu$m from the grain surface.

8. The silver halide emulsion of claim 1, wherein said silver halide grains each contain a region doped with compound (A) in the grain and the boundary of the region doped with compound (A) that is nearest to the surface of the grain is in the grain between 60 to 90% of the grain volume.

9. The silver halide emulsion of claim 1, wherein said silver halide grains each contain a region doped with compound (C) in the grain and the boundary of the region doped with compound (C) that is nearest to the surface of the grain is located at a depth of 0.01 to 0.035 $\mu$m from the grain surface.

10. The silver halide emulsion of claim 1, wherein said silver halide grains each contain a region doped with compound (C) in the grain and the boundary of the region doped with compound (C) that is nearest to the surface of the grain is in the grain between 60 to 90% of the grain volume.

11. The silver halide emulsion of claim 1, wherein said silver halide grains each contain a region doped with compound (B) and a region doped with compound (C) in the grain, said region doped with compound (B) being internal to said region doped with compound (C).

12. The silver halide emulsion of claim 11, wherein said silver halide grains further contain a region doped with compound (A) in the grain, said region doped with compound (A) being external said region doped with compound (B).

13. The silver halide emulsion of claim 12, wherein said region doped with compound (A), region doped with compound (B) and region doped with compound (C) each have a width of not more than 20 mol %, based on silver of the grain.

14. The silver halide emulsion of claim 1 wherein said compound (B) is $K_3RhBr_6$.

* * * * *